US005959578A

United States Patent [19]

Kreutel, Jr.

[11] Patent Number: 5,959,578

[45] Date of Patent: Sep. 28, 1999

[54] ANTENNA ARCHITECTURE FOR DYNAMIC BEAM-FORMING AND BEAM RECONFIGURABILITY WITH SPACE FEED

[75] Inventor: Randall William Kreutel, Jr., Kirkland, Wash.

[73] Assignee: Motorola, Inc., Schaumburg, Ill.

[21] Appl. No.: 09/005,389

[22] Filed: Jan. 9, 1998

[51] Int. Cl.[6] ..... H01Q 3/26

[52] U.S. Cl. ..... 342/373; 342/154; 342/368; 342/376

[58] Field of Search ..... 342/81, 154, 368, 342/373, 374, 376

[56] References Cited

U.S. PATENT DOCUMENTS

| | | | |
|---|---|---|---|
| H57 | 5/1986 | Gabriel et al. | 343/376 |
| 4,277,787 | 7/1981 | King | 343/100 SA |
| 4,736,463 | 4/1988 | Chavez | 455/606 |
| 5,128,687 | 7/1992 | Fay | 343/754 |
| 5,166,690 | 11/1992 | Carlson et al. | 342/157 |
| 5,257,031 | 10/1993 | Scarpetta et al. | 342/374 |
| 5,539,415 | 7/1996 | Metzen et al. | 343/700 MS |
| 5,577,697 | 11/1996 | Lee et al. | 342/368 |
| 5,583,511 | 12/1996 | Halderman | 342/175 |

OTHER PUBLICATIONS

An article entitled A Low Cost, High Performance, Electronically Scanned MMW Antenna by E. O. Rausch and A. F. Peterson, *Microwave Journal,* Jan. 1, 1997 (obtained from the Dow Jones News/Retreival®).

An article from a book entitled "The Handbook of Antenna Design", Editors A.W. Rudge, K. Milne, A.D. Olver & P. Knight, vol. 1, Peter Peregrinus Ltd. on behalf of the Institution of Electrical Engineers.

*Primary Examiner*—Thomas H. Tarcza
*Assistant Examiner*—Dao L. Phan
*Attorney, Agent, or Firm*—Gregory J. Gorrie

[57] ABSTRACT

A switch (10) having a beam-forming network (12) generates independently steerable beams (26). One or more of the independently steerable beams couple in radiating communication with selected ones of M beam ports (18). A feeder array (11) or second beam-former (13) provides signals to radiating elements 19 to form multiple antenna beams for communication.

10 Claims, 2 Drawing Sheets

ANTENNA ARCHITECTURE FOR DYNAMIC BEAM-FORMING AND BEAM RECONFIGURABILITY WITH SPACE FEED

FIELD OF THE INVENTION

This invention relates generally to the field of antennas and, more particularly, to an antenna architecture for dynamic beam-forming and beam reconfigurability.

BACKGROUND OF THE INVENTION

Earth orbiting high gain antenna architectures operate to provide, among other things, signal communication over one or more selected earth coverage areas. To cover the entire earth generally requires a large number of communication beams. In any given antenna architecture, a plurality of beam forming networks normally operate together to receive and transmit communication signals in the form of beams, at least one of the beam forming networks having N beam ports to transmit beams and another having M beam ports to receive and direct the beams to other communication elements in a communication system. In this regard, N is normally substantially less in number than M, M beam ports having to be relatively large in number to accommodate a large number of beams originating from N beam ports. However, only a selected number of M beam ports are needed at any given time during normal operation. Notwithstanding the foregoing, the prior art has failed to provide an antenna architecture operative to provide dynamic beam switching between corresponding beam forming networks that is compact, efficient and easy to implement.

Therefore, what is needed is an antenna architecture for facilitating dynamic beam-forming and beam reconfigurability between corresponding beam forming networks.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DETAILED DESCRIPTION OF THE DRAWINGS

The present invention provides, among other things, an antenna architecture for facilitating dynamic beam-forming and beam reconfigurability. In a further and more specific aspect, the present invention utilizes a wireless switching architecture operative for allowing the efficient switching of beams between a plurality of beam-forming networks. In a spaced-based multiple-beam antenna or phased array antenna in which the field-of-view is large, the ensuing disclosure proposes, in a preferred embodiment, a space feed system.

Figure 1:
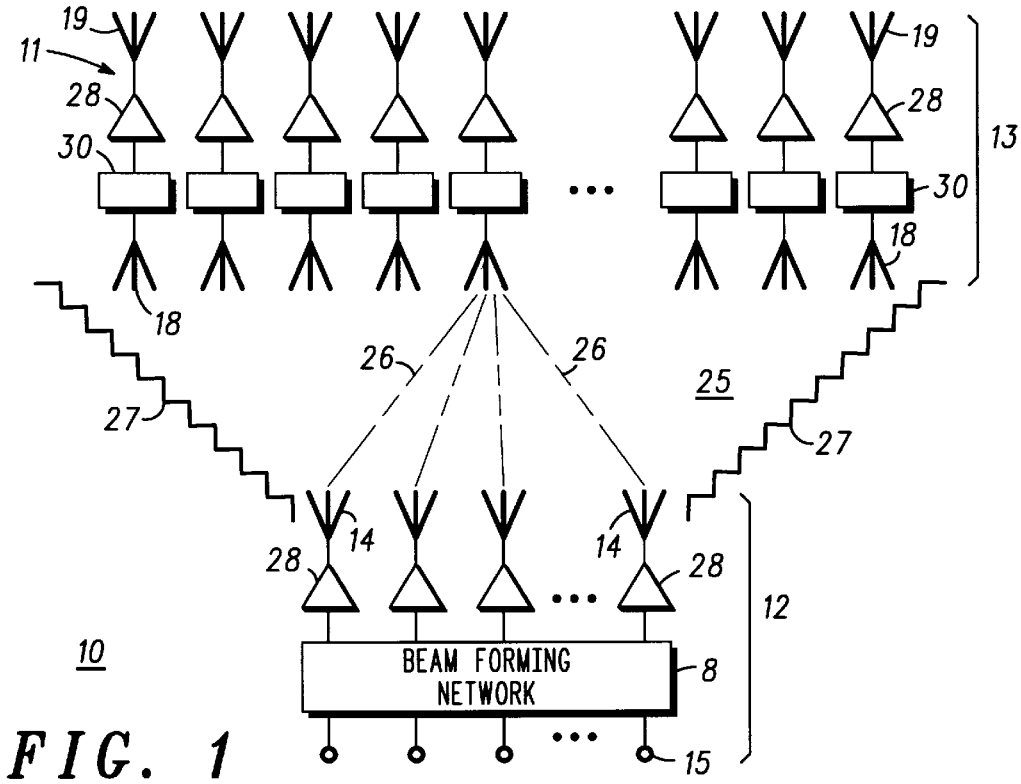
FIG. 1 illustrates a simplified diagram of an antenna architecture for facilitating dynamic beam-forming and beam reconfigurability, in accordance with a first preferred embodiment of the present invention.
Figure 2:
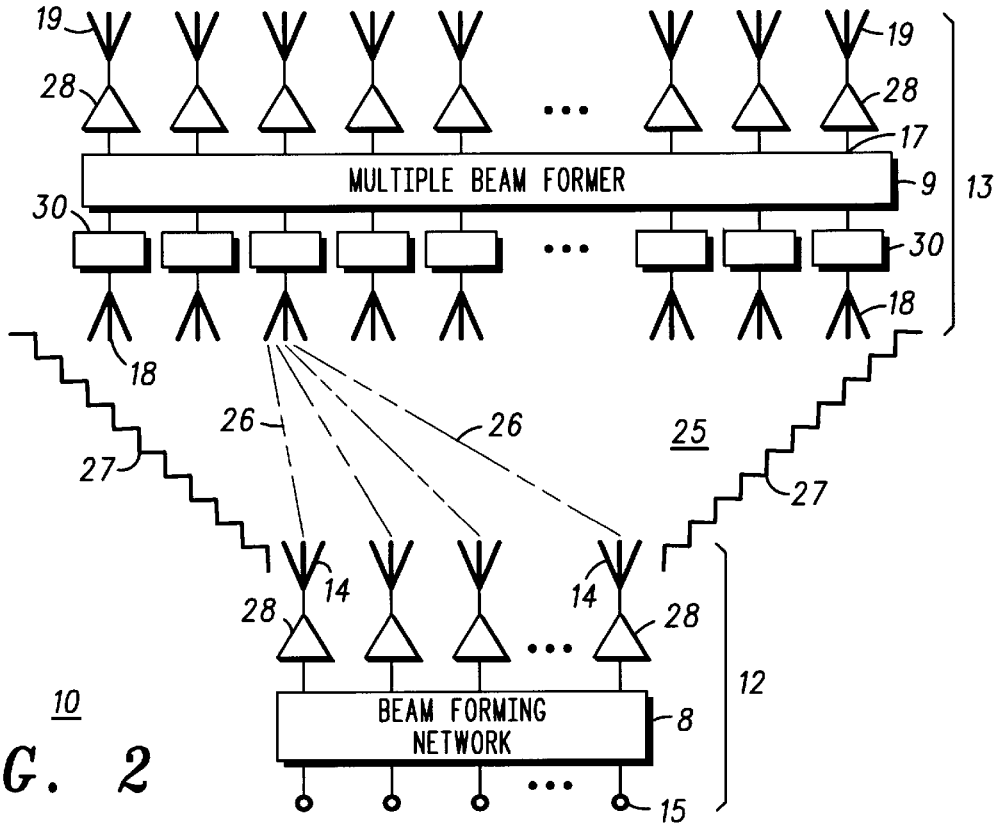
FIG. 2 illustrates a simplified diagram of an antenna architecture for facilitating dynamic beam-forming and beam reconfigurability, in accordance with a second preferred embodiment of the present invention.
Figure 3:
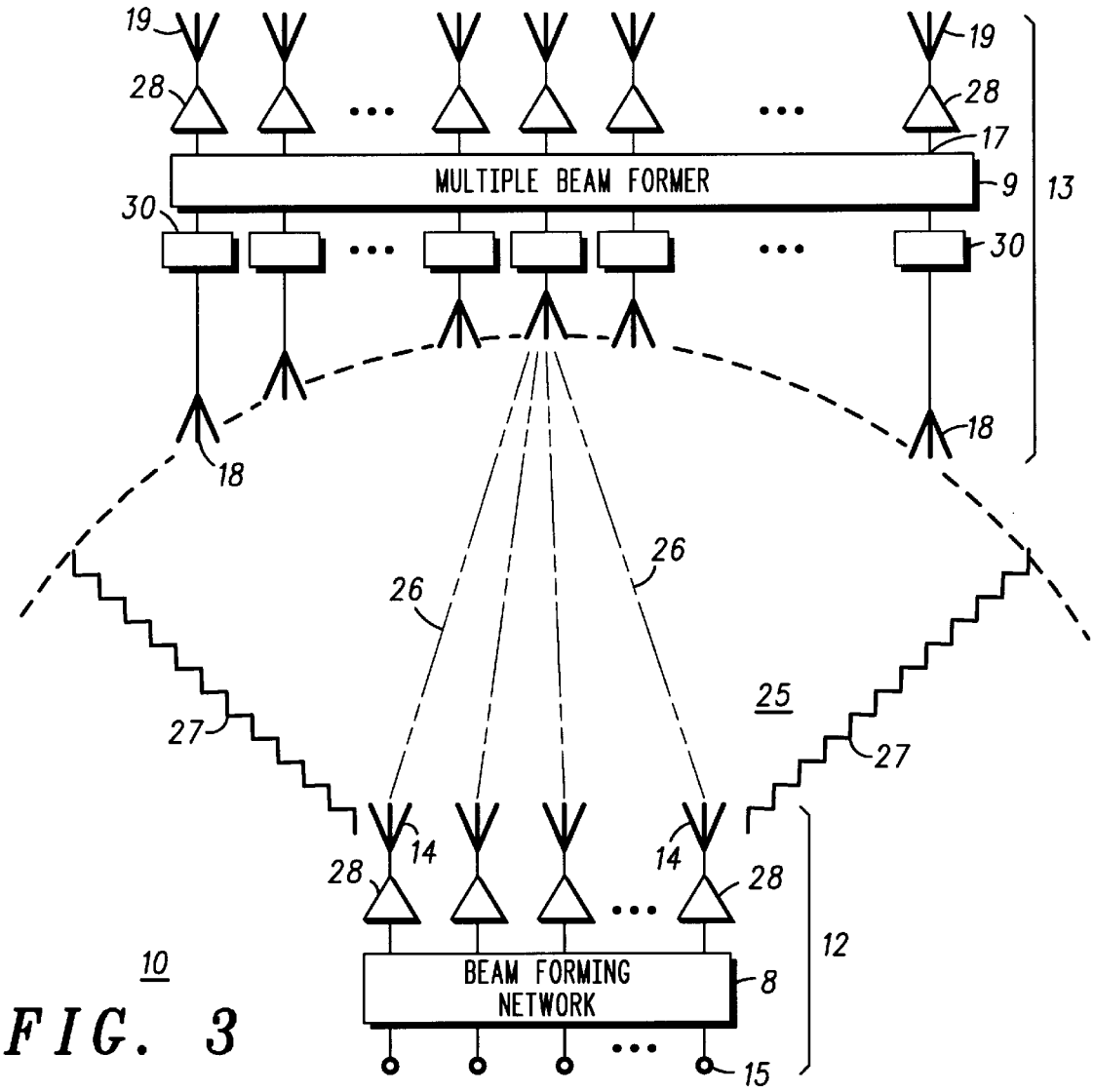
FIG. 3 illustrates a simplified diagram of an antenna architecture for facilitating dynamic beam-forming and beam reconfigurability, in accordance with a third preferred embodiment of the present invention.

With attention directed to FIGS. 1, 2, and 3, illustrated is a schematic diagram of an antenna architecture 10 for facilitating dynamic beam-forming and beam reconfigurability, in accordance with the preferred embodiments of the present invention. Antenna architecture 10 is generally comprised of first beam forming network 12 and second beam forming network 13. First beam forming network 12 is preferably, but not essentially, comprised of a large aperture N-beam phased array antenna or array feed reflector/lens antenna, or laser diode array with N independent beam forming elements 14 operative to generate independently steerable beams, wherein N defines a predetermined plurality.

Second beam-forming network 13 is preferably, but not essentially, comprised of an M beam multiple beam antenna with M discrete beam elements 17, wherein M defines a predetermined plurality such as, for example, 1000 or more. In a first embodiment, each element 17 is coupled with a port 18 which terminate with a radiating element 19 similar to space feed. In this embodiment, beam-forming network 13 is comprised of feeder array 11. In a second embodiment, each of the M ports 18 provides signals to a beam former matrix 9 (FIG. 2) which provides the signal to elements 17, for example. In the second embodiment, beam former matrix 9 may be comprised of Butler Matrices, Rotman Lenses or similar hardware, for example.

First beam forming network 12 and second beam forming network 13 are preferably separated by a chamber or space 25 in spaced-apart relation. In operation, first beam forming network 12 is operative as a beam selector switch operative to illuminate selected and desired ones of ports 18. In this regard, each signal from elements 14 may each focus independently and continuously on an appropriate Mth beam port 18. Although the number of elements 14 in first beam forming network 12 is preferably chosen for achieving adequate beam isolation, the present invention anticipates that the number N of elements 14 required will be significantly less than M because, at any given time, only a fraction or subset of elements 17 are typically envisioned to be accessed at any given moment. As a result, first beam forming network 12 is simple and the dimensionality compact.

Furthermore, and consistent with a preferred embodiment, space 25 is preferably comprised of an anechoic chamber 27 operative to prevent beam reflections, and preferably lined with absorbing material. In one embodiment of the present invention, chamber 27 may be comprised of free-space (e.g., a vacuum), air, gasses or a dielectric material or other transmission medium suitable for the transmission of signals from elements 14 to ports 18.

In one embodiment of the present invention, first beam forming network 12 includes means 8 for proving proper phase and amplitude characteristics of to allow for the generation of the steerable beams 26 by elements 14. Means 8 may be implemented in an analog or digital circuitry, and may include digital beam forming technology.

In one embodiment of the present invention, second beam former matrix 9 is implemented using digital beam former technology. In this regard, each signal from elements 14 may be converted and encoded at element 17 level and separately routed to a digital processor. In this embodiment, the digital processors may be adapted to essentially couple to the desired original beam and null out all others, the digital processor being operative to digitalize each Nth beam 26 of the Nth beam matrix. This identical implementation may also be applied to first beam forming network 12 in the beam transmit environment. In this regard, first beam forming network 12 may be provided with a digital processor, although analog methods may, as an alternative, be otherwise employed as with second beam forming network 13.

In one embodiment, each element 14 provides a signal in the form of a radio-frequency beam. In another embodiment, each element 14 provides a signal in the form of a optical beam. In the later embodiment, each port 18 may be provided with a transducer 30 or conversion point to convert optical signals to radio-frequency signals if desired.

In some applications, amplifiers or amplifier layers are included in architecture 10 for increasing beam signal strength. In this regard, an amplifier layer of amplifiers 28 may be introduced at each element 17 of second beam forming network 13 and/or each element 14 of first beam forming network 12.

In one embodiment of the present invention, (not shown) ports 18 are arranged on a substantially flat and planar surface. In a preferred embodiment, ports 18 are arranged in a substantially circular (two-dimensional) manner, and desirably, arranged in a substantially a spherical (three-dimensional) surface. In this embodiment, ports 18 may be considered approximately equi-distant from the plurality of elements 14, at least for far-field antenna considerations.

Although the present invention is described for signals being introduced at ports 15 and transmitted from elements 14 to ports 18 for receipt at elements 17, and possible subsequent transmission by radiating elements 19, the present invention is equally suitable for the reverse situation. Ports 18 may also radiate signals provided by elements 19 through matrix 9. Beams 26 may receive selected ones of signals transmitted from ports 18 and provide signals to ports 15 through means 8.

In one embodiment, the present invention includes an antenna for providing multiple antenna beams. The antenna includes a feeder array having a first plurality of radiating elements and having a first plurality of ports, and a second plurality of radiating elements for providing internal antenna beams directed to selected ones of the ports of the first plurality. The antenna also includes a beam-forming network for providing signals to each of the radiating elements of the second plurality for generation and direction of the internal antenna beams. The radiating elements of the first plurality provide the multiple antenna beams of the antenna based on the selected ports of the first plurality.

In another embodiment, each radiating element of the first plurality provides one antenna beam of the multiple antenna beams. In another embodiment, the feeder array further comprises a second beam-forming network for providing the multiple antenna beams based on the first plurality of radiating elements, each radiating element contributing to each antenna beam of the multiple antenna beams. Preferably, the ports of the first plurality are arranged in a plane. In another embodiment, the ports of the first plurality are substantially arranged in a spherical configuration, and wherein at least some of the radiating elements of the second plurality are positioned near substantially near a center of the spherical configuration. Preferably, wherein the internal antenna beams, the second plurality of radiating elements and the first plurality of ports are within an anechoic chamber.

In another embodiment, the second plurality of radiating elements generate optical signals that comprised the internal antenna beams, and wherein each port of the first plurality of ports has an optical transducer associated therewith for converting optical signals to RF signals.

In summary, the present invention provides a system and method which utilizes a phased array antenna as a switch in an antenna architecture for facilitating dynamic beam-forming and beam reconfigurability. The present invention utilizes a plurality of beam-forming networks having beam transmit and receive elements, respectively, the number of elements being driven primarily by beam isolation requirements. Because the transmit beam-forming network is preferably comprised of a phased array antenna having N steerable beams to operate as a switch relative a receive beam-forming network preferably comprised of a multiple beam antenna, the number of elements of the transmit beam-forming network is substantially less than the number of elements of the receive beam-forming network that not only contributes to the efficiency of antenna architecture 10, but also its small and relatively compact physical size.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

What is claimed is:

1. A phased array antenna comprising:

a plurality of external radiating elements;

a first beam-forming network coupled to the plurality of external radiating elements, said first beam forming network configured to generate a first plurality of independently steerable beams external to said antenna, the first beam-forming network having M internal beam ports, each of the M beam ports having an internal radiating element of a first set of M internal radiating elements associated therewith; and a second beam-forming network having a second set of internal radiating elements, said second beam forming network configured to generate a second plurality of independently steerable beams internal to said antenna, one or more of the plurality of independently steerable beams internal to said antenna configured to couple in radiating communication with selected ones of the internal radiating elements of said first set associated with the M beam ports, wherein the M internal beam ports and M associated radiating elements of said first set, and the internal radiating elements of said second set are internal to said antenna.

2. The phased array antenna of claim 1, wherein the first plurality of independently steerable beams external to said antenna are less than M.

3. The phased array antenna of claim 2, further comprising a cavity separating the first and second sets of internal radiating elements.

4. The phased array antenna of claim 3, wherein the cavity comprises an anechoic chamber.

5. The phased array antenna of claim 4, further comprising an RF amplifier layer coupled between each of the M internal beam ports and the external radiating elements.

6. The phased array antenna of claim 5, further comprising an amplifier coupled with each radiating element of the second set of internal radiating elements.

7. A beam selector for a multi-beam phased array antenna comprising:

a first beam-forming network coupled to the plurality of external radiating elements, said first beam forming network configured to generate at least one independently steerable beam external to said antenna, the first beam-forming network having M internal beam ports, each of the M beam ports having an internal radiating element of a first set of M internal radiating elements associated therewith, each of the M beam ports being associated with one of said independently steerable beams external to said antenna; and a second beam-forming network having a second set of internal radiating elements, said second beam forming network configured to generate a plurality of independently steerable beams internal to said antenna, one or more of the plurality of independently steerable beams internal to said antenna configured to couple in radiating communication with selected ones of the internal radiating elements of said first set associated with the M beam ports thereby selecting one of said independently steerable beams external to said antenna, wherein the M internal beam ports and M associated radiating elements of said first set, and the internal radiating elements of said second set are internal to said antenna.

8. A phased array antenna as claimed in claim 3 wherein the first set of M internal radiating elements are arranged in a plane.

9. A phased array antenna as claimed in claim 3 wherein the first set of M internal radiating elements are substantially arranged in a spherical configuration, and wherein at least some of the internal radiating elements of the second set are positioned near substantially near a center of the spherical configuration.

10. A phased array antenna as claimed in claim 3 wherein the second set of internal radiating elements generate optical signals comprising the independently steerable beams internal to said antenna, and wherein each of the M internal radiating elements comprises an optical transducer associated therewith for converting optical signals to RF signals.

* * * * *